US009982478B2

(12) United States Patent
Boer

(10) Patent No.: US 9,982,478 B2
(45) Date of Patent: May 29, 2018

(54) DOOR SEAL FITTING

(71) Applicant: Elton Manufacturing, a division of Ontario Door Sales Ltd., Milton (CA)

(72) Inventor: Anthonie Boer, Campbellville (CA)

(73) Assignee: Elton Manufacturing, a division of Ontario Door Sales Ltd., Milton, Ontario (CA)

( * ) Notice: Subject to any disclaimer, the term of this patent is extended or adjusted under 35 U.S.C. 154(b) by 0 days. days.

(21) Appl. No.: 15/351,919

(22) Filed: Nov. 15, 2016

(65) Prior Publication Data

US 2017/0218689 A1 Aug. 3, 2017

Related U.S. Application Data

(60) Provisional application No. 62/288,118, filed on Jan. 28, 2016.

(51) Int. Cl.

| | |
|---|---|
| ***E06B 7/22*** | (2006.01) |
| ***E06B 7/23*** | (2006.01) |
| ***E06B 9/58*** | (2006.01) |

(52) U.S. Cl.

CPC ..... *E06B 7/22* (2013.01); *E06B 7/2312* (2013.01); *E06B 9/58* (2013.01); *E06B 2009/588* (2013.01)

(58) Field of Classification Search

CPC ..... E06B 3/88; E06B 7/231; E06B 7/2316; E06B 7/2307; E06B 7/22; E06B 7/16

USPC ..... 49/475.1, 489.1, 492.1

See application file for complete search history.

(56) References Cited

U.S. PATENT DOCUMENTS

| | | | | |
|---|---|---|---|---|
| 2,428,731 A * | 10/1947 | Abrams | E06B 7/231 49/490.1 |
| 3,324,598 A * | 6/1967 | Tinfow | E06B 7/2316 49/482.1 |
| 4,283,884 A | 8/1981 | Dumenil et al. | |
| 4,463,540 A | 8/1984 | Gordon | |
| 4,497,136 A * | 2/1985 | Khallil | E06B 7/16 49/480.1 |

(Continued)

FOREIGN PATENT DOCUMENTS

| | | |
|---|---|---|
| DE | 20117000 U1 | 4/2003 |
| EP | 682905 A1 | 11/1995 |
| EP | 1072751 A2 | 1/2001 |

OTHER PUBLICATIONS

Total Patent: English machine translation of German patent publication No. DE20117000U1, published on Apr. 10, 2003.

(Continued)

*Primary Examiner* — Justin B Rephann

(74) *Attorney, Agent, or Firm* — Kenneth L. Bousfield; Bereskin & Parr LLP/S.E.N.C.R.L., s.r.l.

(57) ABSTRACT

A door seal fitting, such as for a garage door, may include a main body or mounting fitting; a cap, and the door seal itself. The mounting fitting has a back web or wall that is attached to a door post or door jamb. The cap seats on the mounting fitting to conceal the mounting hardware of the mounting fitting. The door seal is located in a T-shaped slot on the doorward end of the mounting fitting. It is secured by mechanical fasteners that are hidden behind the seal. The mechanical fasteners pass through a web of the mounting fitting and through a wing or internal leg of the cap. The fasteners are spaced along the length of the assembly to discourage axial shrinkage or shifting of the cap relative to the mounting fitting.

20 Claims, 6 Drawing Sheets

(56) References Cited

U.S. PATENT DOCUMENTS 4,690,862 A * 9/1987 Hoffmann ..... B29C 44/22 156/244.12
5,007,203 A * 4/1991 Katrynuik ..... E06B 7/2301 49/482.1
5,191,704 A * 3/1993 McCarty ..... E06B 3/365 29/462
5,214,880 A * 6/1993 Woodruff ..... E06B 3/88 49/470
5,216,839 A * 6/1993 Woodruff ..... E05D 5/0238 49/382
5,230,180 A 7/1993 Tweedt et al.
5,435,104 A * 7/1995 Dietrich ..... B60J 5/14 49/475.1
5,682,715 A * 11/1997 McKann ..... E06B 1/16 49/504
5,784,834 A * 7/1998 Stutzman ..... E06B 7/2307 49/197
6,253,493 B1 * 7/2001 Sauve ..... F25D 23/087 49/305
6,772,560 B2 * 8/2004 Dischiant ..... E06B 7/23 49/197
6,772,561 B1 * 8/2004 Berger, Jr. ..... E06B 1/522 160/40
7,111,433 B2 9/2006 Kerscher
7,971,400 B2 7/2011 Boldt et al.
8,109,053 B2 2/2012 Smith
8,881,464 B1 * 11/2014 Huckeba ..... E06B 7/231 49/197
8,910,421 B2 12/2014 Potter
9,045,937 B2 6/2015 Peck et al.
9,068,391 B2 6/2015 Peck et al.
2005/0223647 A1 * 10/2005 Stutzman ..... E06B 7/22 49/499.1
2014/0259954 A1 * 9/2014 Peck ..... E06B 7/16 49/489.1

OTHER PUBLICATIONS

Total Patent: English machine translation of European patent publication No. EP1072751A3, published on Jul. 3, 2002.

* cited by examiner

DOOR SEAL FITTING

CROSS-REFERENCE TO RELATED APPLICATIONS

This application claims the benefit of the filing date of U.S. Provisional Application No. 62/288,118, filed Jan. 28, 2016, entitled Door Seal Fitting, the content of which is incorporated herein by reference.

FIELD OF THE INVENTION

This invention relates to the field of doors seals and related mounting fittings.

BACKGROUND OF THE INVENTION

In door seal assemblies there may be a mounting fitting that is secured to the door post or door jamb, and a door seal that seats in the mounting fitting. It is often desirable for mounting hardware, such as mechanical fasteners to be concealed from view. To that end, there may be a cap or other cosmetic covering that fits on the mounting fitting.

SUMMARY OF THE INVENTION

In an aspect of the invention there is a door seal mounting assembly. It has a door seal holder and a cap. The door seal holder has a base member; a first seat in which to mount a door seal; and a second seat defining an accommodation for the cap. The cap has a facing and a first wing. The base member has a mounting portion for attachment to a door post by mounting hardware. The cap, when located in the cap seat, conceals the mounting hardware. The base member has a wall through which to drive mounting hardware to secure the base member to the door post, and also as a first arm extending away from the back and away from the door post. When the cap is mounted in the second seat, the facing conceals the mounting hardware of the base member. When the cap is mounted in the second seat, the wing and the web of the base member are opposed, whereby they may be secured together.

In a feature of that aspect of the invention, as installed, a plurality of axially spaced mechanical fasteners secure the first wing and the web of the first arm of the base member. In another feature, the door seal assembly includes a door seal mounted in the first seat, and, when so mounted, the door seal obscures from view mechanical fasteners securing the first arm and first wing together. In another feature, the cap mates with the second seat in a snap fit condition. In still another feature, the door seal holder has a guide. The guide is positioned inwardly of, and in opposition to the first arm. The guide is positioned to intercept the first wing on entry of the cap into the first seat. The guide constrains deflection of the first wing away from the first arm.

In another feature, when assembled, the cap has a facing that lies substantially flush with the door seal holder. In still another feature, at least one of the base member and the cap is an extrusion. In a further feature, the wing is a first wing, and the cap has a second wing, the first and second wings being symmetrically opposed. In still another feature, the back has a centering indexing groove formed therein.

In another feature, the door seal holder is an extruded plastic member. The cap is an extruded plastic member. The door seal holder has a substantially planar back for placement against a door post. A first arm extends away from the back. A second arm extends away from the back. The first and second arms define first and second opposed sides of the second seat. The first arm also has a slot defining the first seat. The first arm defines a first web. The wing is a first wing and the cap also has a second wing. The first and second wings are opposed and the cap is symmetrical about a centerline. When the cap is mounted in the second seat, the first and second wings being concealed by the facing. When the cap is mounted in the second seat, the first wing and the first web being opposed to permit a mechanical fastener to be driven through both. In a further feature, the door seal mounting assembly is found in combination with a door seal, the door seal being mounted in the first seat, and, when so mounted, the mechanical fastener also passes through the door seal and is hidden by the door seal.

In another aspect of the invention there is any combination of any of the features of any one of embodiments shown or described herein, in combination with the features of any other embodiment, except to the extent those features are mutually exclusive. In another aspect of the invention, there is any apparatus substantially as shown or described herein, in whole or in part.

BRIEF DESCRIPTION OF THE DRAWINGS

These aspects and other features of the invention can be understood with the aid of the following illustrations of a number of exemplary, and non-limiting, embodiments of the principles of the invention in which.

DETAILED DESCRIPTION

Figure 1A:
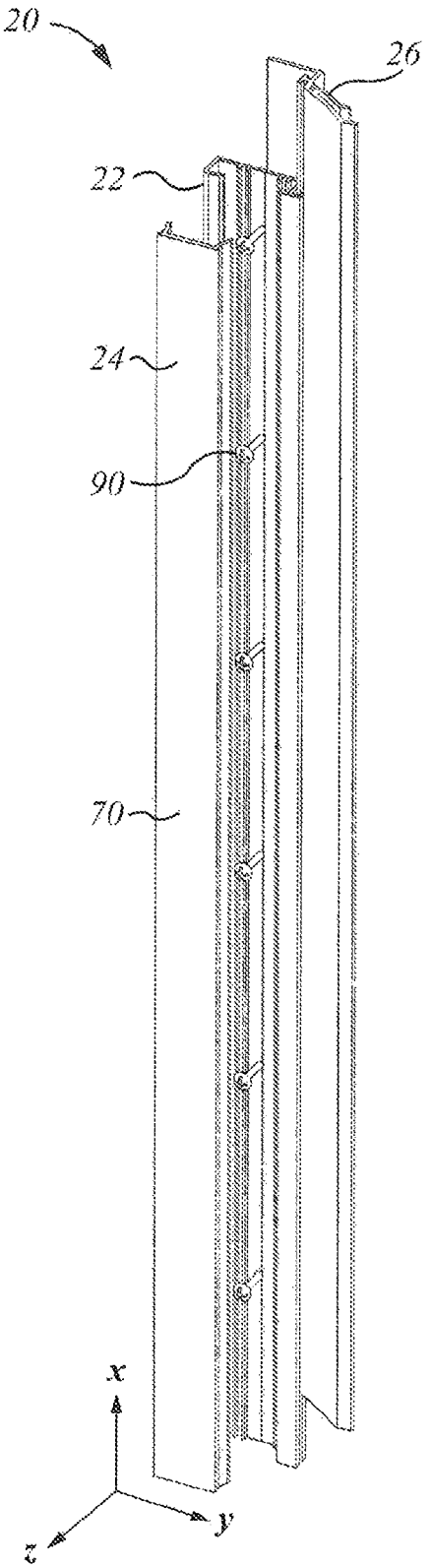
FIG. 1*a* shows a perspective view of a portion of a door seal assembly.
Figure 1B:
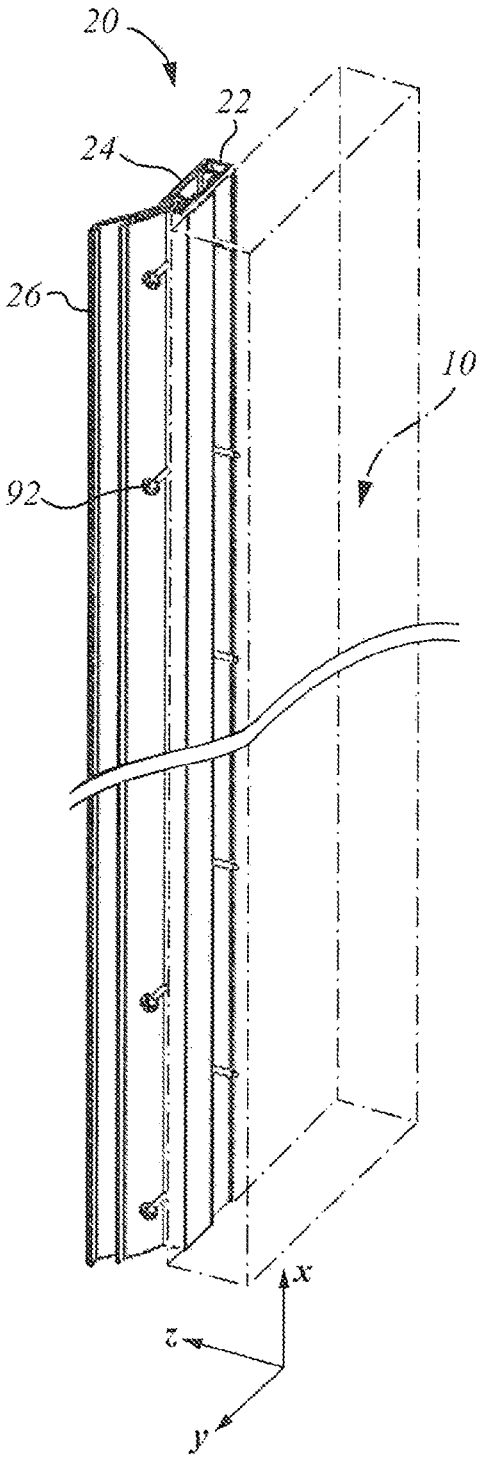
FIG. 1*b* shows another perspective view of the assembly of FIG. 1*a*, taken approximately at a right angle to the view of FIG. 1*a;*
Figure 2:
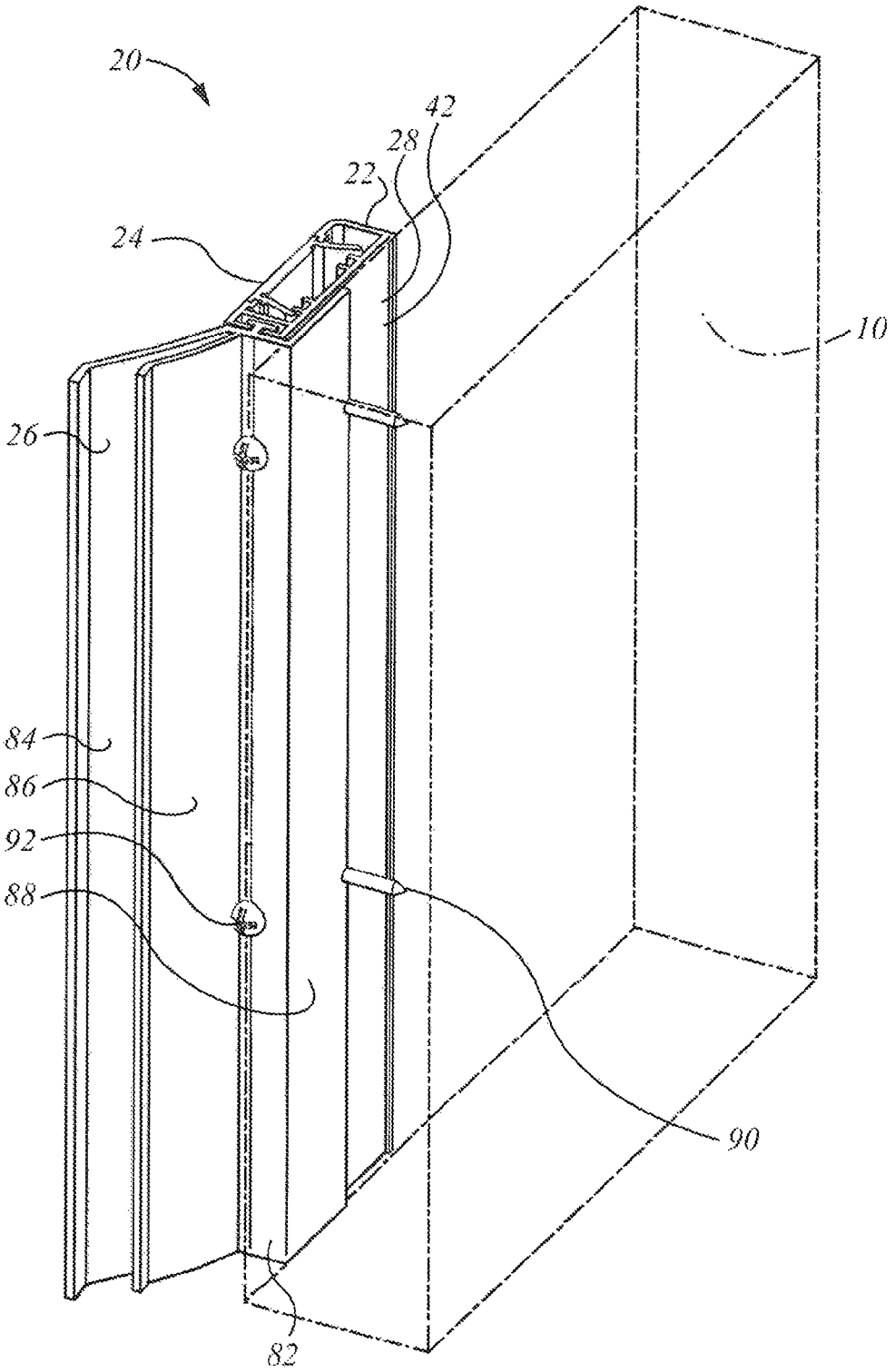
FIG. 2 is an enlarged detail of FIG. 1*b;*
Figure 3B:
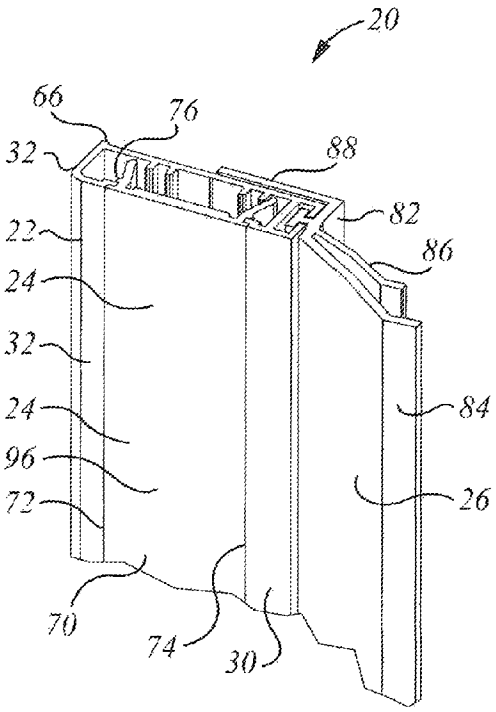
FIG. 3*b* shows the features of FIG. 3*a* as assembled.
Figure 3A:
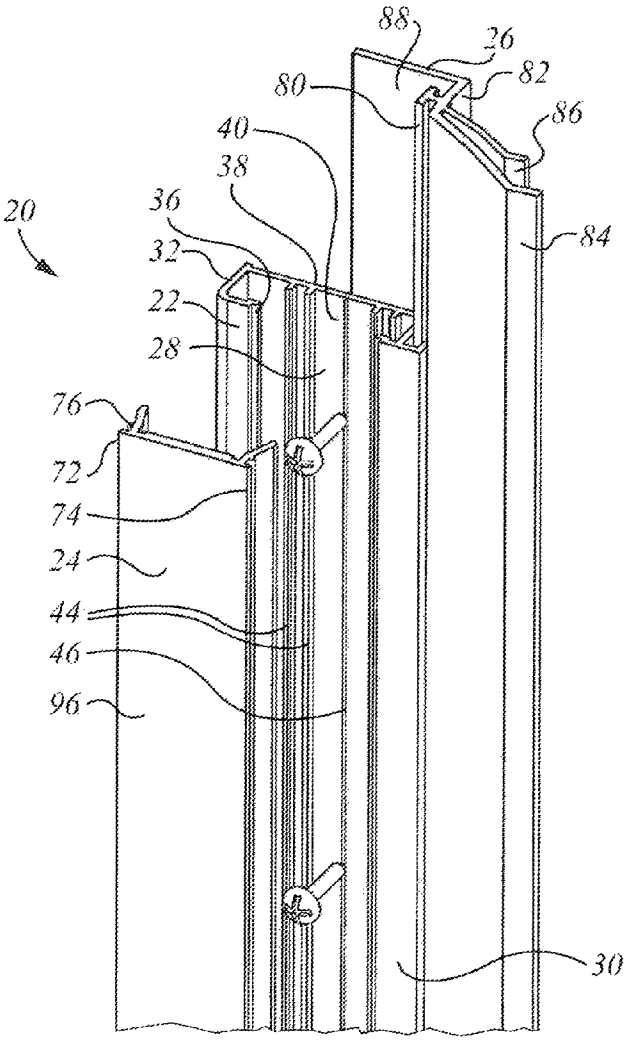
FIG. 3*a* is an enlarged detail of FIG. 1*a*, in partially exploded form.

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings may be understood to be to scale and in proportion unless otherwise noted. The wording used herein is intended to include both singular and plural where such would be understood, and to include synonyms or analogous terminology to the terminology used, and to include equivalents thereof in English or in any language into which this specification may be translated, without being limited to specific words or phrases.

For the purposes of this description, it may be that a Cartesian frame of reference may be employed. In such a frame of reference, the long, or largest, dimension of an object may be considered to extend in the direction of the x-axis, the base of the article, where substantially planar, may be considered to extend in an x-y plane, and the height of the article may be measured in the vertical, or y-direction. Accordingly, the width of the window assembly described herein may be arbitrarily designated as the x-direction; and the height may be arbitrarily designated as the y-direction. The through-thickness is then the z-direction. In the present specification, reference is made to door trim fittings that nay be formed as extruded members. When speaking of extrusions, the direction of extrusion is the x-direction, the lateral direction is the y-direction, and the through-thickness is the z-direction. In terms of the context of a door seal fitting assembly such as mounted to a door post, the x-direction then also becomes the vertical direction, the y-direction is the horizontal direction parallel to the face of the door post or door jamb, and the z-direction is the direction horizontal and perpendicular to the door post or door jamb. Unless noted otherwise, the terms "inside" and "outside", "inwardly" and "outwardly", refer to location or orientation relative to the door. In this description, when an item, or structure, or wall, is indicated as being insulated, such term is understood to mean that the wall has a layer of insulation. In this specification, The commonly used engineering terms "proud", "flush" and "shy" may be used to denote items that, respectively, protrude beyond an adjacent element, are level with an adjacent element, or do not extend as far as an adjacent element, the terms corresponding conceptually to the conditions of "greater than", "equal to" and "less than".

Referring to the Figures, and by way of a general overview, a door seal assembly is indicated generally as 20, such as for mounting to a door post or door jamb 10. Door seal assembly 20 may be a garage door seal, for use with a multi-section track-following roll-up door. Door seal assembly 20 has a first, or mounting, member 22; a second, or cap, cap member 24; and a door seal 26. All of members 22, 24, and 26 may be extrusions, and the direction of extrusion may be termed the axial direction. The mounting member 22 may have the form of a mounting bracket, or channel, having a first portion or member, or base member, or back, identified as 28; and a pair of first and second arms 30, 32. Mounting member 22 also has a first seat, namely a door seal seat, 34. Mounting member 22 also has a second seat, namely a cap seat 36 which defines an accommodation for receiving cap member 24.

Back 28 of mounting member 22 may include a planar, or substantially planar, main portion 38 which may have an externally facing wall surface 40, and an internally facing wall surface 42. Back 28 may also have a spaced array of stiffening ribs 44. Along the centerline about which the ribs are symmetrically spaced there may be a centerline slot or groove 46. On the doorward end of back 28 there may be a finger 48. Finger 48 stands outwardly of back 28, pointing away from the door jamb.

First arm 30 may include a web 50 that stands perpendicularly away from the internal face of back 28, on the door-ward end thereof relative to ribs 44. Web 50 may be substantially planar. The proximal end of web 50 is rooted to back 28. The distal end of web 50 stands outwardly away from back 28. At the inside of the distal end is a stepped flange, or rail, 52 that defines one half of second seat 36. At the door-ward side first arm 30 may include a flange 54 having a backwardly bent toe 56.

Door seal seat 34 may be the T-shaped slot 60 defined between have the opposed first and second spaced apart angled legs formed by flange 54 and toe 56 on one hand, and by the door-ward end and finger 48 on the other hand, door-ward of web 50.

Second arm 32 may include a web 62 and an inwardly turned stepped flange 64 that stands in opposition to rail 52, those two elements defining the respective doorward and outward halves of cap seat 36, spaced symmetrically inboard and outboard of groove 46. At the jamb end of second arm 32 there may be a protrusion, or stub, or toe, or dog, or fulcrum 66.

Figure 4:
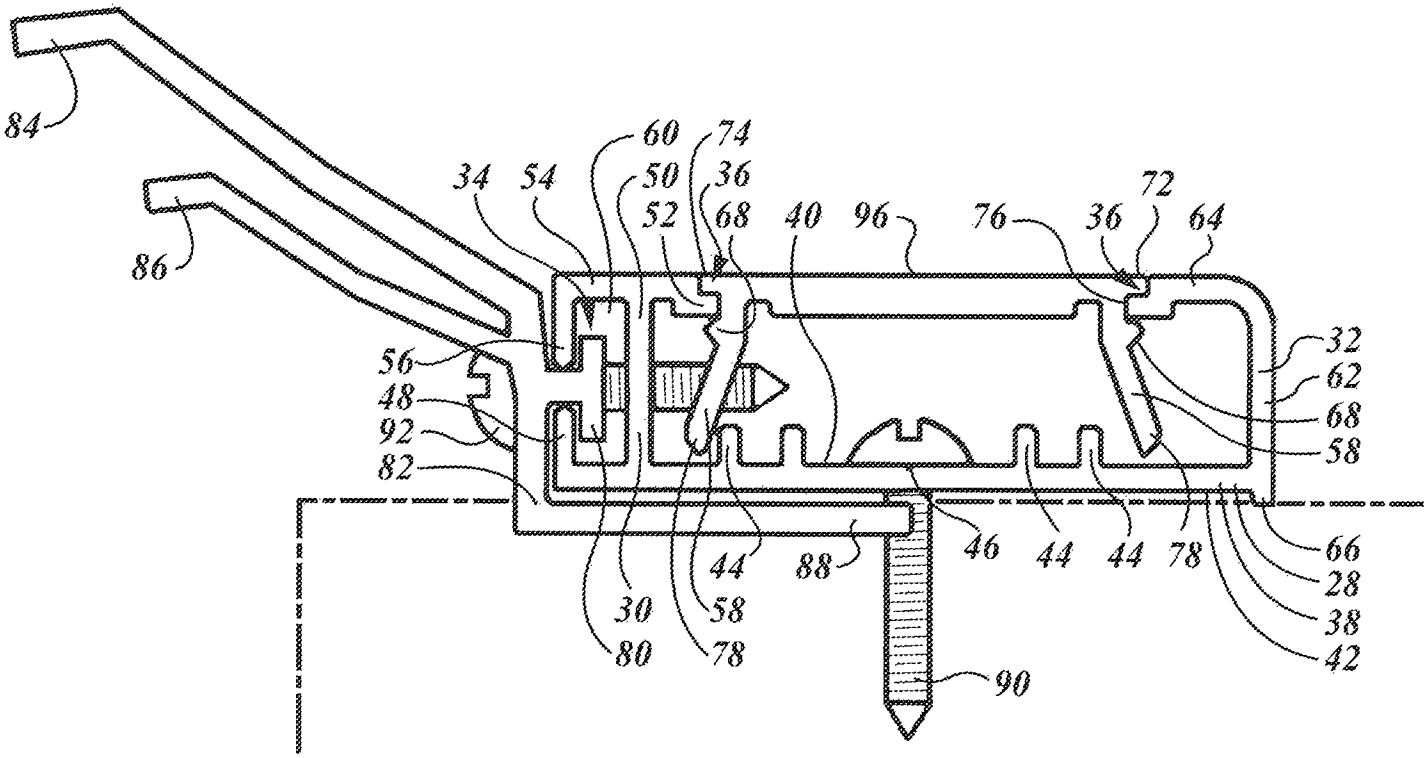
FIG. 4 is a cross-section of the base fitting of the door seal assembly of FIG. 1*a;*

Cap 24 may be an extrusion, and may include a main portion, or web, 70 having first and second (or outboard and inboard) edges 72, 74 such as engage corresponding reliefs formed in the stepped-edge flanges 54 and 64 of first and second arms 30, 32 of mounting member 22. At each of inboard and outboard edges 72, 74 may be formed a channel, or ledge, or notch, or accommodation 76, such as may engage the stepped toe of flange 54 or 64 as may be, such that cap 24 may be restrained in the direction normal to back 28 (and therefore also to the doorjamb, 10), and such that the external face 96 of cap 24 may lie flush with, or substantially flush with, the outward extremities of arms 30, 32, such that the externally exposed surface of the assembly as a whole may be generally smooth. At each end of cap 24, a wing or leg 58 extends inwardly and away from web 70. Each wing or leg 58 is canted or splayed outward, and has, adjacent its root, a catch, notch, abutment, or detent 68. Each leg 58 is biased outward to stand, at rest, in the splayed condition. On being squeezed toward each other, legs 58 can be introduced between the opposed halves of seat 36. As cap 24 is driven forward toward back 28, and home such that the respective ends of web 70 seat in the accommodations defined by the stepped edges or toes of flanges 54 and 64. The act of engagement causes the sloped cam faces of detents 68 to ride against those toes, thereby deflecting and releasing detents 68 and causing a snap fit. Wing 58 is of a length such that the distant tip of wing 58 does not bottom out on back 28 of mounting member 22 before cap 24 is home and engaged in second seat 36. However, as tip 78 advances, it extends past the extremity of the raised ribs 44, (i.e., rib 44 then defining a guide), and may be deflected by rib 44, as seen in FIG. 4, in the direction tending more strongly to force detents 68 against first and second arms 30, 32.

Door seal 26 may be of many different shapes and sizes. In the embodiment shown, door seal has a root 80, a main web 82, a primary wiper 84, a secondary wiper 86, and a flange or anchor web 88. Root 80 is sized to fit within slot 60, the stem fitting in the gap between finger 48 and toe 56, and the cross-bar of the T of root 80 being spaced from main web 82 to admit, and capture, finger 48 and toe 56 therebetween.

Main web 82 and anchor web 88 may lie at right angles, the one forming, in effect, a flange to the other. Main web 82 may be sized to be a strip having an inside dimension corresponding to the depth of mounting member 22 across the end face defined by finger 48 and toe 56. When installed, mounting hardware 90, e.g., a screw or nail, is driven through back 28 at centerline groove 46 and into jamb 10 mounting member 22 pivots on fulcrum 66, and anchor web is squeezed between back 28 and jamb 10.

Cap 24 is then introduced between flanges 54 and 64 and driven home. Once in place, wing 58 stands generally in opposition to web 50, and spaced therefrom. A mechanical fastener 92 (again, a screw or nail) is driven centrally into main web 82, between finger 48 and toe 56, and generally centrally through web 50 of first arm 30. As it advances further inwardly, it encounters and pierces wing 58, thereby inhibiting wing 58 from axial movement relative to mounting member 22. In this process, wing 58 is inhibited from deflecting away from mechanical fastener 92 by the presences of one or another of ribs 44, which function as abutments, or stops, that limit its backward deflection. Additional mechanical fasteners 92 can be driven into wing 58 at axially spaced locations therealong, to the far end thereof, thereby tending to discourage movement of wing 58, and consequently web 70 and cap 24 generally, relative to mounting member 22. In this condition, cap 24 conceals mounting hardware 90. It may also be noted that fasteners 92 also provide spaced securement of door seal 26 to mounting member 22 as well. Where a plurality of fasteners is spaced along the various parts, those fasteners may tend to discourage axial shrinkage or movement between the parts. It may also be notes that as installed, fasteners 92 may tend not to be externally visible. That is, from the front side they are hidden by mounting member 22. Laterally fasteners are hidden behind door seal 26, being between door seal 26 and the door post or jamb 10. Rearwardly fasteners 92 are hidden by the door itself when closed. The door may be a sectional rolling garage door.

On some occasions, a garage door portal may be exposed to the sun for relatively long periods of time, and the air circulation adjacent to the door may be minimal. Particularly where the door seal and trim fittings are darker colours, the plastic extrusions may tend to become warm. At times the cap may become warm enough that it may tend to want to shrink or twist, or distort. Shrinkage in the axial direction may then leave a gap. The underlying mounting fitting may be secured along its length to the door post, and so may be restrained against shrinkage. By using a plurality of axially spaced apart mechanical fasteners 92, such as screws, the cap 24 may then also be constrained in terms of shrinkage or movement relative to the underlying mounting member. Mechanical fasteners 92 are placed on the door-ward side of the assembly, and, unlike the exposed outward side, are concealed from view by the seal itself. When thus held at both ends, and perhaps at additional intermediate positions, cap 24 may be discouraged from moving or distorting. The juxtaposition, i.e., the opposed, axially running placement, of the web of the stationary back member, namely web 30, and the corresponding web of the cap member, namely wing or leg 58 of cap 24, provides two reference elements that may then be held together, or interlinked, or secured, in axial position to restrain relative motion between the parts. In the example this interlinking is achieved by mechanical fasteners 92. Conveniently, fasteners 92 are effectively hidden from view behind door seal 26.

Figure 5:
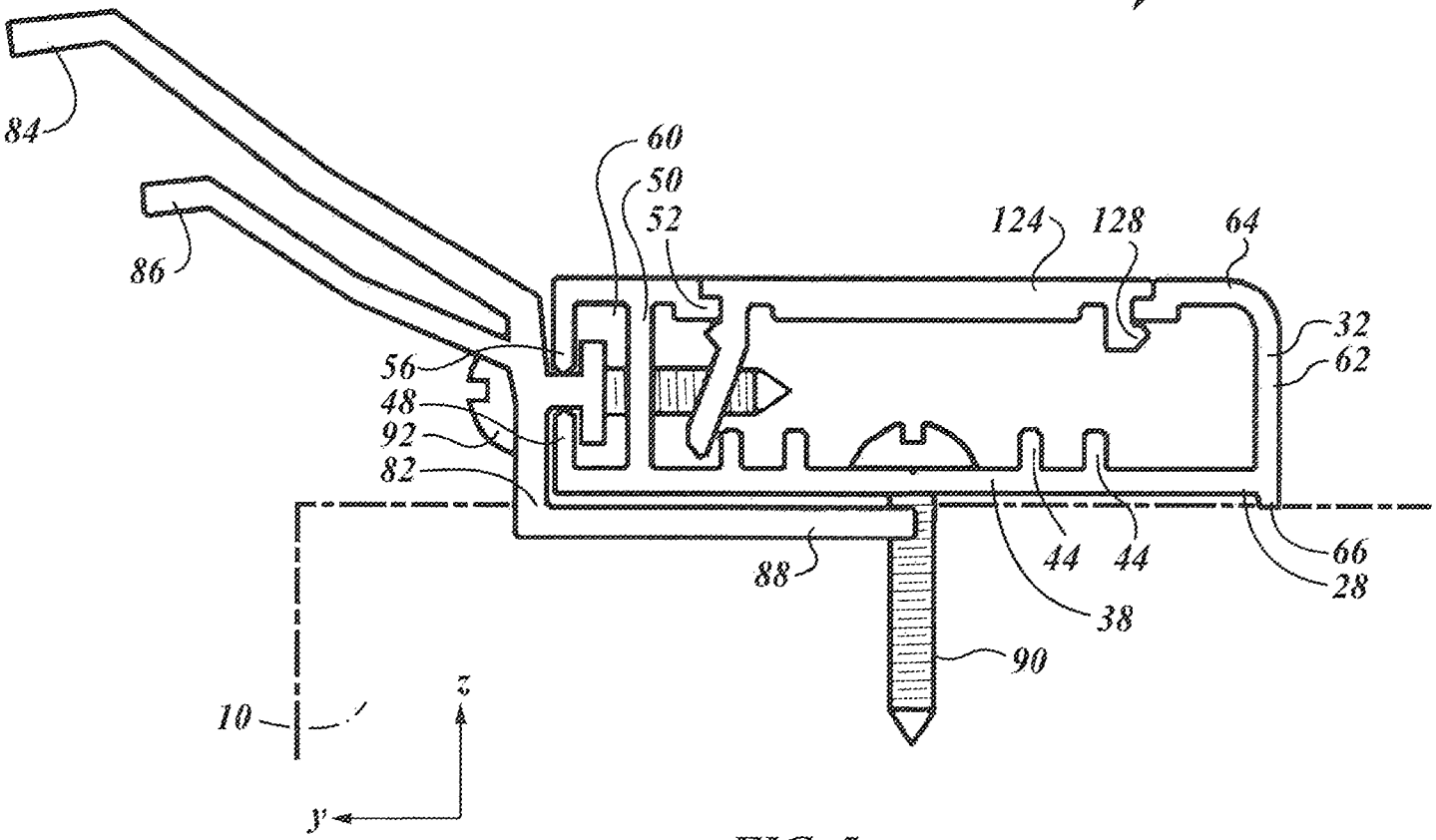
FIG. 5 is a cross section of an alternate embodiment to that of FIG. 4.

The embodiment of FIG. 5 is substantially similar to the embodiment of FIG. 4, but rather than having two wings 58, in assembly 120, cap 124 has only a single wing 58. Whereas cap 24 is symmetrical, and can be turned end-for-end as the user may please, cap 124 is not symmetrical. Otherwise it is the same, and installation is as above, except that the short detent 128 is engaged on the stepped edge of second arm 32 first, and then wing 58 is moved inside of the stepped edge of arm 30.

Figure 6:
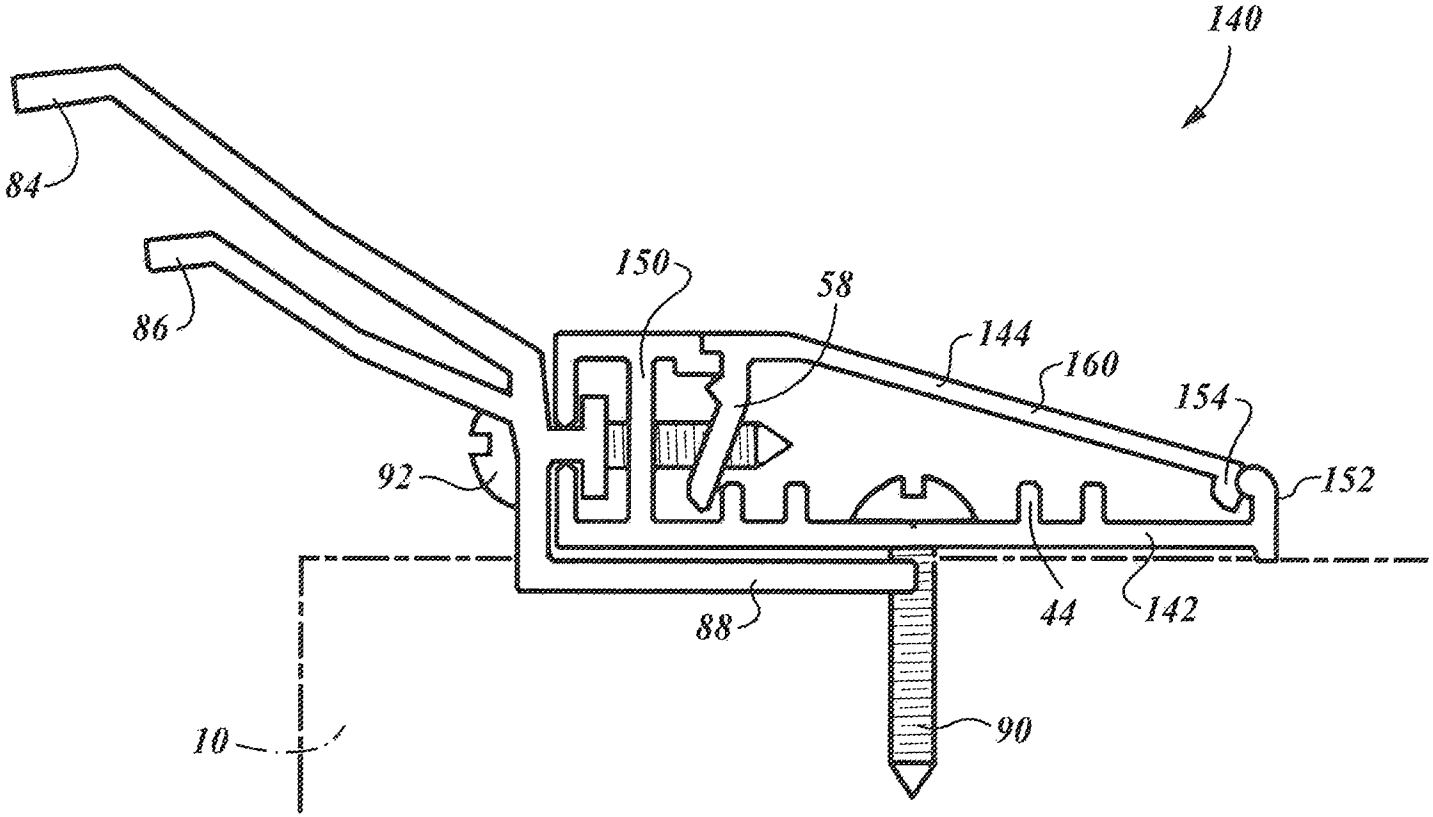
FIG. 6 is a cross-section of a further alternate embodiment to that of FIG. 4.

The embodiment of FIG. 6 is substantially similar to the embodiments of FIGS. 4 and 5. However, in this instance, assembly 140 has a mounting member 142 that has a first arm 150, but, in place of second arm 32, assembly 140 has a very small arm, or a ledge, or abutment, or rail, or stop 152. Likewise, cap 144 has one side and one wing for engaging first wing 30, as before. Cap 144 also has, however, an opposite edge, or foot 154 that engages stop 152. Stop 152 and foot 154 may have a male-and-female mating arcuate relationship such that then may be first engaged, and web 160 rotated to bring wing 58 into engagement as before. In this instance, cap 144 is not symmetrical, and mounting member 142 has only one arm, not two. Furthermore, whereas the outward presentation face of cap 24 may be substantially parallel to the face of the door post or door jamb 10, the outward face 156 of cap 144 is not. It may be inclined obliquely, or rounded to form a relatively smooth presentation surface.

In the embodiments shown and described, the mounting member, the cap, and the door seal are all extrusions. The door seal is typically a flexible rubber member. The mounting member and the cap may be made of a rigid plastic.

Although the various embodiments have been illustrated and described herein, the principles of the present invention are not limited to these specific examples which are given by way of illustration, but only by a purposive reading of the claims.

I claim:

1. A door seal mounting assembly comprising:

a door seal holder and a cap;

said door seal holder having a base member;

said door seal holder having a first seat in which to mount a door seal;

said door seal holder having a second seat defining an accommodation for said cap;

said cap having a facing and a first wing;

said base member having a mounting portion for attachment to a door post;

said base member mounting portion having a wall through which to drive mounting hardware to secure said base member to the door post, said base member mounting portion having a first arm, said first arm including a first web extending away from said base member;

when said cap is mounted in said second seat, said facing concealing the mounting hardware of said base member;

when said cap is mounted in said second seat, said first wing of said cap and said first web of said first arm of said base member being opposed to each other and extending to permit a mechanical fastener to be driven through said first web of said first arm of said base member and through said first wing of said cap; and said first seat being positioned such that when the door seal is positioned in said first seat, the mechanical fastener is concealed from view.

2. The door seal mounting assembly of claim 1, including the mounting hardware and a plurality of the mechanical fastener, wherein, on installation of the door seal mounting assembly, said mounting hardware secures said base member to the door post, and a plurality of axially spaced ones of said mechanical fasteners secure said first wing of said cap to said first web of said first arm of said base member.

3. The door seal mounting assembly of claim 1 wherein said door seal mounting assembly includes said door seal mounted in said first seat, and, when so mounted, said door seal obscures from view the mechanical fastener securing said first arm and said first wing together.

4. The door seal mounting assembly of claim 1 wherein said cap mates with said second seat in a snap fit condition.

5. The door seal mounting assembly of claim 1 wherein said door seal holder has a guide, said guide being positioned inwardly of, and in opposition to said first arm, said guide being positioned to intercept said first wing on entry of said cap into said first seat, said guide constraining deflection of said first wing away from said first arm.

6. The door seal mounting assembly of claim 1 wherein, when assembled, said facing of said cap lies substantially flush with said door seal holder.

7. The door seal mounting assembly of claim 1 wherein at least one of said door seal holder and said cap is an extrusion.

8. The door seal mounting assembly of claim 1 wherein said cap has a second wing, said first and second wings of said cap being symmetrically opposed.

9. The door seal mounting assembly of claim 1 wherein said wall of said mounting portion of said base member has a centering indexing groove formed therein.

10. The door seal mounting assembly of claim 1 wherein said door seal holder and said cap have respective first and second ends, and a first mechanical fastener is driven through said first wing of said cap and said first web of said first arm of said door seal holder at said respective first ends; and a second mechanical fastener is driven through said first wing of said cap and said first web of said first arm of said door seal holder at said respective second ends.

11. A door seal mounting assembly comprising:

a door seal holder and a cap;

said door seal holder having a base member;

said door seal holder having a first seat in which to mount a door seal;

said door seal holder having a second seat defining an accommodation for said cap;

said cap having a facing and a first wing;

said base member having a mounting portion for attachment to a door post;

said base member mounting portion having a wall through which to drive mounting hardware to secure said base member to the door post, said base member mounting portion having a first arm, said first arm including a web extending away from said base member;

when said cap is mounted in said second seat, said facing concealing the mounting hardware of said base member;

when said cap is mounted in said second seat, said first wing of said cap and said web of said first arm of said base member being opposed;

the door seal holder is an extruded plastic member;

the cap is another extruded plastic member;

said mounting portion of said door seal holder has a substantially planar back for placement against the door post;

said first arm extends away from said back;

a second arm extends away from said back, said first and second arms defining respective first and second opposed sides of said second seat;

said first arm also having a slot defining said first seat;

said cap also has a second wing, said first and second wings of said cap being opposed and said cap being symmetrical about a centerline;

when said cap is mounted in said second seat, said first and second wings of said cap are concealed by said facing; and when said cap is mounted in said second seat, said first wing and said first web are opposed to permit a mechanical fastener to be driven through both.

12. The door seal mounting assembly of claim 11 in combination with said door seal, said door seal being mounted in said first seat, and, when so mounted, the mechanical fastener also passes through said door seal and is hidden by said door seal.

13. The door seal mounting assembly of claim 11 wherein said door seal mounting assembly includes said door seal mounted in said first seat, and, when so mounted, said door seal obscures from view the mechanical fastener securing said first arm and said first wing together.

14. The door seal mounting assembly of claim 11 wherein said cap mates with said second seat in a snap fit condition.

15. The door seal mounting assembly of claim 11 wherein said door seal holder has a guide, said guide being positioned inwardly of, and in opposition to said first arm, said guide being positioned to intercept said first wing on entry of said cap into said first seat, said guide constraining deflection of said first wing away from said first arm.

16. The door seal mounting assembly of claim 11 wherein, when assembled, said facing of said cap lies substantially flush with said door seal holder.

17. The door seal mounting assembly of claim 11 wherein at least one of said door seal holder and said cap is an extrusion.

18. The door seal mounting assembly of claim 11 wherein said first and second wings of said cap are symmetrically opposed.

19. The door seal mounting assembly of claim 11 wherein said wall of said mounting portion of said base member has a centering indexing groove formed therein.

20. The door seal mounting assembly of claim 11 wherein said door seal holder and said cap have respective first and second ends, and a first mechanical fastener is driven through said first wing of said cap and said first web of said first arm of said door seal holder at said respective first ends; and a second mechanical fastener is driven through said first wing of said cap and said first web of said first arm of said door seal holder at said respective second ends.

* * * * *